United States Patent [19]

Won

[11] Patent Number: 4,619,392

[45] Date of Patent: Oct. 28, 1986

[54] STAPLER WITH STAPLE STORAGE AREA IN BASE

[76] Inventor: Duk S. Won, 42 Kennedy Dr., West Haverstraw, N.Y. 10993

[21] Appl. No.: 715,030

[22] Filed: Mar. 22, 1985

[51] Int. Cl.[4] ..... B25C 5/02; B25C 5/11

[52] U.S. Cl. ..... 227/120; 227/113

[58] Field of Search ..... 227/120, 113, 156

[56] References Cited

U.S. PATENT DOCUMENTS 3,037,206 6/1962 Lash ..... 227/120

3,289,910 12/1966 Lescure ..... 227/120 X 3,302,842 2/1967 MacEachron ..... 227/120

3,665,580 5/1972 Mashita ..... 227/120 X

*Primary Examiner*—Paul A. Bell

*Attorney, Agent, or Firm*—Birch, Stewart, Kolasch & Birch

[57] ABSTRACT

A stapler comprising a storage area disposed in a base thereof for loading staples and paper clips, a closing base plate member having a window for checking on the supply of staples which is mounted to the base pivotally and closed in the base member to hold the staples within the storage area and a magnetic plate disposed at the other end portion of the base for retaining surplus paper clips within the base of the stapler.

8 Claims, 4 Drawing Figures

STAPLER WITH STAPLE STORAGE AREA IN BASE

BACKGROUND OF THE INVENTION

The present invention relates to a stapler containing a storage area for loading staples and paper clips, and more particularly, to a stapler assembly having a storage area disposed in the base thereof, including a tray for loading staples and a magnetic plate for holding paper clips and a closing base plate member pivotally attached to the base of the staples.

Staples of many designs are well known in the art. It is also known that staplers utilize staples which must always be readily available for reloading the stapler when necessary. Frequently, one finds oneself in a position of needing a supply of staples but not being able to find them. Paper clips are also an item in frequent demand and thus, when they are not readily available when needed, considerable inconvenience is experienced. Unavailability of paper clips and staplers is frequently experienced when traveling.

OBJECTS AND SUMMARY OF THE INVENTION

Accordingly, it is an object of the present invention to provide a stapler containing a storage area for holding staples and paper clips.

Another object of the present invention is to provide a stapler having a hollow base for housing staples and paper clips utilizing a closing base member and a magnetic plate.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly, the present invention comprises a stapler containing a storage area disposed in the base for loading staples and paper clips, a closing base plate member is pivotally mounted to the base and closes in the base member to hold the staples within the storage area. A magnetic plate is also provided for holding the paper clips within the base of the stapler.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
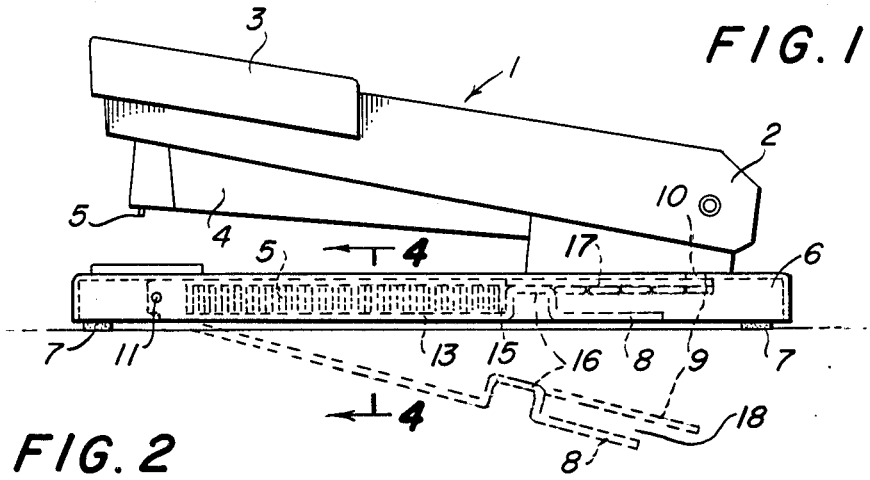
FIG. 1 is a side view showing the basic components of the stapler containing a storage area as defined by the present invention.
Figure 2:
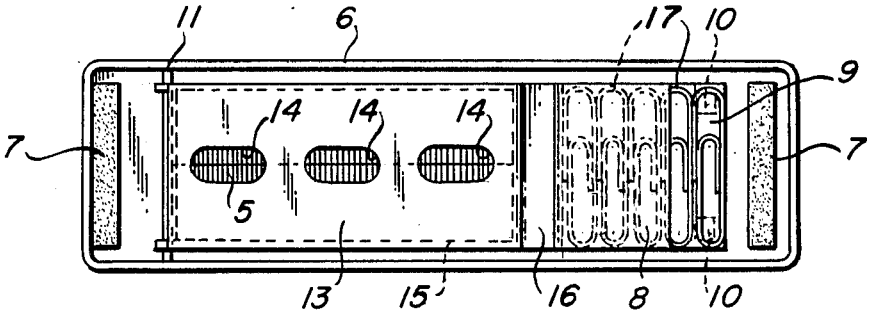
FIG. 2 is a bottom view of the base member in its closed operative position.
Figure 3:
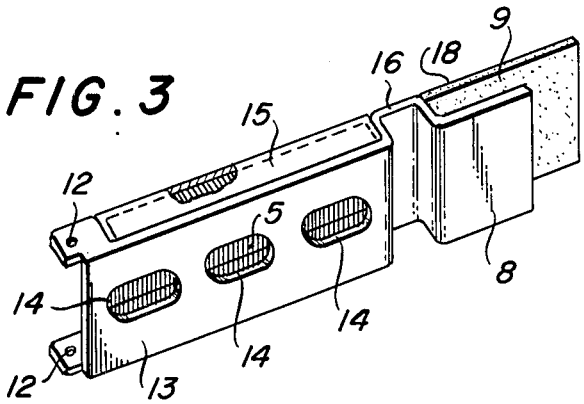
FIG. 3 is a perspective view showing the closing base plate member of the present invention.
Figure 4:
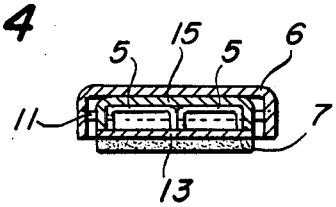
FIG. 4 is a cross-sectional end view taken along line 4—4 of FIG. 1.

Referring now in detail to the drawings for the purpose of illustrating a stapler 1 of the present invention, the lower base portion of the stapler is provided with a chamber 6 for housing additional staples 5 and paper clips 17 and an operating handle 3 connects pivotally to the lower base portion through a pin 2. Also, a magazine 4 includes a plurality of staples 5. A closing base plate member 13 which can be made of plastic or rubber is rotatably attached to one end of the stapler 1 by pivot member 11 disposed on holes 12 of the base plate whereby the base plate member 13 can rotate to close on the chamber 6 in the base portion of the stapler to provide a location for storing staples 5 and paper clips 17. The base plate member 13, provided at the front of the stapler, could alternatingly be pivoted from the rear end thereof by merely providing a reversal of the various elements making up the storage area in the base of the device. The base plate member 13 has a U-shaped configuration 16 from one end thereof which divides the chamber 6 into a stapler storage area containing a tray 15 and a paper clip storage area 18 for housing paper clips 17. One end of the base plate member 13 has windows 14 for checking on the supply of staplers and the other end portion thereof forms a handle 8 which compacts with the magnetic plate member 9 to define an area for retaining surplus paper clips. In the embodiment as shown, the magnetic plate 9 is attached to the closing base plate member 13 and is held in a closed position within the base of the stapler by its magnetic attachment to magnetic pad members 10 fixed within the chamber 6 of the base of the stapler 1. Alternatively the magnetic plate member 9 can be fixed to the top of the chamber 6 with the base plate rotating to close thereon to form a separate chamber for housing the surplus paper clips 17. In this embodiment, the closing base plate member 13 can be provided with a means for biasing this member in a closed position. Alternatively another magnetic pad member 10 can be disposed opposite the U-shaped configuration 16 which can be made to be magnetically attracted to the pad member 10. Although the staples 5 can be stored in tray 15, the staples can also be stored without trays by using the side walls of the base of the stapler. Also, foot pads 7 are posted on the base of the stapler to provide friction against sliding.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A stapler comprising an upper base member, a lower base member, said lower base member containing a chamber, a base plate member pivotally attached to one end of the lower base member, said base plate member being adapted to close in said chamber and divide it into two storage areas, and means for holding said base plate member in a closed position so that said chamber can house a supply of staples and paper clips, said holding means being magnetic pads disposed in said chamber.

2. The stapler of claim 1, wherein the base plate member in the staple storage area cooperates with the side walls of the lower base member to define said staple storage area.

3. The stapler of claim 1, wherein a base plate member is divided into a staple storage area and a paper clip storage area, and the magnetic plate member is attached to said base plate member in the paper clip storage area.

4. The stapler of claim 3, wherein the plane of the base plate member is changed in at least one portion thereof to define said staple storage area and the paper clip storage area.

5. The stapler of claim 4, wherein the change in the plane of the base plate has an inverse U-shaped configuration.

6. The stapler of claim 3, wherein the free end of the base plate member operates as a handle and cooperates with the magnetic plate to define said paper clip storage area.

7. The stapler of claim 3, wherein trays containing staples are disposed in staple storage area.

8. The stapler of claim 3, wherein the base plate member in the staple storage area is provided with windows for determining the supply of staples stored therein.

* * * * *